United States Patent [19]

Haman et al.

[11] Patent Number: 4,656,092

[45] Date of Patent: Apr. 7, 1987

[54] TARGET SHOOTING CAPSULES

[75] Inventors: Frederic E. Haman, Clearwater; Keith E. Schmoke, Safety Harbor, both of Fla.

[73] Assignee: R. P. Scherer Corporation, Troy, Mich.

[21] Appl. No.: 787,508

[22] Filed: Oct. 15, 1985

[51] Int. Cl.[4] ..... B41M 5/00

[52] U.S. Cl. ..... 428/402.2; 102/502; 102/513; 102/529; 252/308; 252/309; 8/403; 106/19; 106/22; 106/244

[58] Field of Search ..... 102/502, 513, 529; 428/402.2; 252/308, 309; 106/19, 22, 23, 27, 244, 251; 8/403

[56] References Cited

U.S. PATENT DOCUMENTS

| | | | |
|---|---|---|---|
| 1,970,396 | 8/1934 | Scherer . | |
| 2,288,327 | 6/1942 | Scherer . | |
| 2,318,718 | 5/1943 | Scherer . | |
| 3,861,943 | 1/1975 | Grainger . | |
| 4,251,276 | 2/1981 | Ferree, Jr. et al. | 106/27 |
| 4,304,601 | 12/1981 | Sharp | 106/29 |
| 4,403,550 | 9/1983 | Sharp | 101/452 |

FOREIGN PATENT DOCUMENTS

| | | |
|---|---|---|
| 1263522 | 2/1972 | United Kingdom . |
| 1268635 | 3/1972 | United Kingdom . |

OTHER PUBLICATIONS

Ebert, W. R., "Soft Elastic Gelatin Capsules: A Unique Dosage Form,: Pharmaceutical Technology, Oct. 1977.

Stanley, J. P., "Soft Gelatin Capsules,: The Theory and Practice of Industrial Pharmacy, 359–84 (Lea & Febiger ed. 1970).

*Primary Examiner*—John E. Kittle

*Assistant Examiner*—Patrick J. Ryan

*Attorney, Agent, or Firm*—Allegretti, Newitt, Witcoff & McAndrews, Ltd.

[57] ABSTRACT

A target shooting capsule comprising a substantially spherical, nontoxic, soft elastic gelatin capsule having a dry wall thickness of about 0.004 inches to about 0.013 inches, having a diameter of about 0.16 inches to about 0.265 inches, and containing about 0.03 cc to about 0.12 cc of a water washable, nontoxic fill material.

9 Claims, No Drawings

TARGET SHOOTING CAPSULES

BACKGROUND OF THE INVENTION

1. Field of the Invention

This invention relates to a novel target shooting capsule comprising a relatively small diameter, nontoxic, soft elastic gelatin capsule. It further relates to a method of target shooting which uses the target shooting capsule containing a water washable, nontoxic dye with an air powered rifle or handgun.

2. Description of Related Art

The use of standard lead or steel pellets for target shooting in small caliber air powered rifles and handguns is well-known. However, such use presents an inherent safety hazard due to the potential ricochet. Additionally, the use of standard lead or steel pellets in air powered rifles and handguns generally limits recreational target shooting to locations of wide-open spaces or specially constructed shooting ranges due to the inherent safety hazard. It is generally unacceptable to conduct recreational target shooting with standard lead or steel pellets in the home, or outside the home in a typical urban/suburban setting. Also, the use of standard lead or steel pellets for target shooting generally requires each participant to utilize a separate target for himself or herself, such as a paper "bulls eye" target, which is subsequently destroyed in the process of target shooting.

Using a soft gelatin capsule in a marking method for marking trees with a marking fluid has been described in U.S. Pat. No. 3,861,943. According to that description, the gelatin capsule has a wall thickness from 0.02 inches to 0.03 inches and a diameter of about 0.25 inches to 0.75 inches. The capsule contains from 0.25 cc to 1.25 cc of marking fluid, generally a pigmented liquid such as paint, lacquer or the like, and is useful for marking trees with the marking fluid. However, this marking capsule presents certain disadvantages in other applications such as target shooting. In particular, the amount and type of fluid in the capsule create difficulties in use for target shooting. A main problem is caused by the fact that the shape of the capsule is based on the amount of fluid contained therein. As a result, the capsule is grossly inaccurate for target shooting because the capsule is not spherical. Further, the amount and type of marking fluid create a very large splatter mark, around two inches in diameter, that is suitable for trees but useless for competitive target shooting. Also, breakages of the capsules containing indelible fluids may be difficult to wash clean from clothing or other unintended areas of exposure. Another problem is that these capsules cannot be readily used with conventional air guns. That is, the gun must be modified to conform to the capsules.

SUMMARY OF THE INVENTION

It is therefore an important object of the present invention to provide a target shooting capsule that shoots reliably, without bursting in the gun barrel and bursts on impact against a solid target.

Another object is to provide a target shooting capsule that is comparable to lead or steel pellets in diameter and is comparably spherical to lead or steel pellets for accuracy.

A further object is to provide a shell and fill material that are made from nontoxic materials in case of accidental ingestion.

A still further object is to provide a fill material that is readily water washable to prevent accidental, permanent staining of clothing, buildings, carpeting or other areas of potential exposure and to allow utilization of reusable targets which can be easily washed clean.

Another further object is to provide a fill material that maintains a relatively small "splatter" or explosion area on the target at impact, does not drip or run to any great degree from the target impact point and explodes in a relatively circular pattern from the target impact point.

Another still further object is to provide a fill material that is not hygroscopic so as to avoid absorption of moisture in humid environments, thereby expanding and increasing the diameter of the capsule, causing the capsule to not fit in the gun, or to burst prematurely due to internal pressures.

Further purposes and objects of the present invention will appear as the specification proceeds.

With the foregoing and other objects in view, the invention herein provides a target shooting capsule comprising a nontoxic, soft elastic gelatin capsule having a diameter of approximately 0.16 inches to approximately 0.265 inches, having a dry wall thickness of about 0.004 inches to about 0.013 inches and containing approximately 0.03 cc to approximately 0.12 cc of various water washable, intensely colored, nontoxic liquids.

DETAILED DESCRIPTION OF THE PREFERRED EMBODIMENTS

The present invention concerns a soft elastic gelatin capsule which is useful as a substitute for standard lead or steel pellets used in recreational target shooting with small caliber air powered rifles and handguns. The capsules burst on impact and allow for the utilization of reusable targets. The capsules do not ricochet, and can be reasonably used for recreational target shooting in areas where lead or steel pellets cannot be used. The capsule is produced with completely nontoxic materials, and will cause no chemical harm if accidentally ingested.

The soft elastic gelatin capsule shell used in the compositions of this invention may be formulated in accordance with conventional techniques for making filled, seamless, soft elastic gelatin capsules containing a fill material. See. e.g., Ebert, W. R., "Soft elastic gelatin capsules: a unique dosage form," Pharmaceutical Tech., October 1977; Stanley, J. P., "Soft Gelatin Capsules," The Theory and Practice of Industrial Pharmacy, 359–84 (Lea & Febiger ed. 1970). Optionally, the gelatin shell may contain preservatives such as mixed parabens, ordinarily methyl or propyl parabens, in about 4:1 ratio. The parabens may be incorporated in the shell formulation in minor proportions as compared to the total weight of the shell formulation. Conventional gelatin capsules utilize gelatin having a bloom value of about 140–200 although this amount may be varied. Using conventional techniques, the gelatin composition is mixed and melted under vacuum conditions. The capsules may be simultaneously formed and filled using a conventional method and apparatus such as those using rotary die process, as disclosed, for example, in U.S. Pat. Nos. 1,970,396; 2,288,327; and 2,318,718. Such equipment is commercially used, for example, by R. P. Scherer Corporation and utilizes the said rotary die process for encapsulating various fill materials in a gel mass. It is to be understood, however, that the particular method used for making the soft elastic gelatin shell is not considered part of the invention herein.

The gelatin capsules may be formed into a substantially spherical shape and varying sizes depending upon the caliber of the air powered rifle or hand gun. For example, a substantially spherical gelatin capsule may be made with a slight modification to the diameter to accommodate a variety of small caliber air guns, i.e., .177, .22, .25, .32, .38, .45, etc. Preferably, the gelatin capsule will have a diameter ranging from about 0.16 inches to about 0.265 inches and, more desirably, will have a diameter of about 0.177 inches, about 0.22 inches or about 0.25 inches. Additionally, the gelatin capsules used in the instant invention will have a dry wall thickness in varying degrees, typically in the range of about 0.004 inches to about 0.013 inches and preferably about 0.007 inches to about 0.01 inches.

The fill material used in this invention is a water washable, nontoxic dye mixture. Any color or color combination may be employed but the particular choice of a coloring powder selected is preferably bright and intense so as to be readily visible on a target at a reasonable distance for recreational target shooting. The fill material is desirably formulated in various colors to allow competition shooting by several participants against a single target. Approximate fill material quantities for substantially spherical capsules vary depending upon the diameter of the gelatin capsule. For example, the fill material quantities for capsules used in common small caliber guns such as .177, .22 and .25, which corresponds to the diameter in inches, may be approximately 0.03 cc, approximately 0.06 cc and approximately 0.12 cc, respectively. Other quantities may be employed though less conveniently.

Typical compositions comprising blue, green, orange and red fill materials are illustrated below. While the following Formulas I–IV show approximate quantities of each ingredient as preferred ranges, it should be appreciated that each ingredient may be present in varying amounts.

| Ingredient | Amount (% w/w) |
|---|---|
| Formula I: Blue Fill Material | |
| Water | 0.7–0.9 |
| FD & C Blue Powder | 0.05–0.2 |
| Titanium Dioxide | 0.05–0.2 |
| Vegetable Shortening | 4.0–7.0 |
| Vegetable Oil | 87.7–93.2 |
| Fumed Silica | 2.0–4.0 |
| Formula II: Green Fill Material | |
| Water | 0.8–1.0 |
| FD & C Yellow Powder | 0.1–0.3 |
| FD & C Blue Powder | 0.005–0.02 |
| Titanium Dioxide | 0.05–0.2 |
| Vegetable Shortening | 4.0–7.0 |
| Vegetable Oil | 87.4–94.0 |
| Fumed Silica | 2.0–4.0 |
| Formula III: Orange Fill Material | |
| Water | 0.8–1.0 |
| FD & C Yellow Powder | 0.1–0.4 |
| Titanium Dioxide | 0.05–0.2 |
| Vegetable Shortening | 4.0–7.0 |
| Vegetable Oil | 87.0–93.0 |
| Fumed Silica | 2.0–4.0 |
| Formula IV: Red Fill Material | |
| D & C Red Powder | 0.4–0.7 |
| Vegetable Oil | 95.0–98.0 |
| Fumed Silica | 2.0–4.0 |

The general method (A) for preparing the above fill material compositions of Formulas I–III is described as follows. A dye and water solution is prepared and added to a suitable mixing container of vegetable shortening. Mixing continues until the mixture is uniform. Preferably, the shortening should not be mixed to a liquid state, i.e., it should remain in a semi-solid state while mixing. Separately, fumed silica is added to the vegetable oil while stirring. Then, the shortening, dye and water mixture is added while stirring until uniform. The temperature of the mixture should not exceed about 32° C. After mixing, the batches are cooled to room temperature. Prior to encapsulation, the mixture is restirred carefully to avoid incorporating air into the mixture.

For a bright red fill material (Formula IV), the general procedure (B) consists of mixing the red coloring powder with the vegetable oil and then adding fumed silica. Mixing continues until uniform. The temperature should not exceed about 32° C. After mixing, the red batch is cooled to room temperature. Prior to delivery to capsulation, the mixture is restirred carefully to avoid incorporating air into the mixture. If shades of red are desired, D & C red powder may be substituted for the F D & C blue powder in Formula I and general method (A) may be followed.

This invention contemplates the use of the nontoxic, soft elastic gelatin capsule containing a colorful fill material in recreational target shooting, with small caliber air powered rifles and handguns. In practice, when shot at a target, the gelatin capsules of the present invention provide a mark which stays in one spot without dripping and creates an impact point of less than about one inch in diameter. These gelatin capsules may also find application in amusement parks, for law enforcement purposes or by the military for combat games.

The following examples demonstrate certain aspects of the present invention. However, it is to be understood that these examples are for illustrative purposes only and do not purport to be wholly definitive as to conditions and scope of this invention. It also should be appreciated that when typical reaction conditions (e.g., temperature, reaction times) have been given, the conditions which are both above and below these specified ranges can also be used, though generally less conveniently.

A further understanding of the invention may be obtained from the following nonlimiting examples. These examples were conducted at room temperature (about 23° C. to about 28° C.) and at atmospheric pressure.

EXAMPLE 1

PREPARATION AND ENCAPSULATION OF TARGET SHOOTING CAPSULES CONTAINING A BLUE FILL MATERIAL

Formula I

| Ingredient | Amount (g) |
|---|---|
| Purified Water, U.S.P. | 8.90 |
| FD & C Blue #1 Powder | 1.36 |
| Titanium Dioxide | 0.75 |
| Vegetable Shortening | 58.50 |
| Soybean Oil, U.S.P. | 900.99 |
| Fumed (Colloidal) Silica | 29.50 |
| | 1000.00 |

Into a suitable container is weighed 8.9 g of hot, purified water, U.S.P. The container of water is placed under a variable speed mixer and the agitator is adjusted to proper mixing height. While stirring, 1.36 g of F D & C Blue #1 powder is slowly added to the water and mixing is continued for approximately five (5) minutes or until powder is dissolved. While stirring, 0.75 g of titanium dioxide is added and stirring is continued for approximately five (5) minutes or until the dye and water solution is uniform.

Into a suitable mixing container is weighed 58.5 g of vegetable shortening which has been maintained at room temperature. The container of vegetable shortening is placed under a high speed mixer equipped with a dissolver blade and, while slowly stirring, the dye and water solution prepared above is added. Mixing is continued until the mixture is uniform. The shortening is kept in a semi-solid state while mixing.

To a container, 900.99 g of soybean oil, U.S.P. is added. While stirring under a high speed mixer equipped with a dissolver blade, 29.5 g of fumed (colloidal) silica is added. Stirring is continued until the mixture is uniform. While stirring, the shortening, dye and water mixture prepared above is added. The temperature of the mixture is kept below about 32° C. After mixing, the batch is allowed to cool to room temperature. The mixture is restirred prior to encapsulation.

Separately, using conventional techniques, substantially spherical soft elastic gelatin capsules are prepared to have a dry wall thickness of about 0.008 inches and a diameter of about 0.25 inches and are filled with approximately 0.12 cc of the blue fill material.

EXAMPLE 2

PREPARATION AND ENCAPSULATION OF TARGET SHOOTING CAPSULES CONTAINING A GREEN FILL MATERIAL
Formula II

| Ingredient | Amount (g) |
|---|---|
| Purified Water, U.S.P. | 9.0 |
| FD & C Yellow #5 Powder | 2.0 |
| FD & C Blue #1 Powder | 0.1 |
| Titanium Dioxide | 1.0 |
| Vegetable Shortening | 58.0 |
| Soybean Oil, U.S.P. | 900.9 |
| Fumed (Colloidal) Silica | 29.0 |
| | 1000.0 |

The product of Example 2 is prepared and encapsulated according to the procedure of Example 1.

EXAMPLE 3

PREPARATION AND ENCAPSULATION OF TARGET SHOOTING CAPSULES CONTAINING AN ORANGE FILL MATERIAL
Formula III

| Ingredient | Amount (g) |
|---|---|
| Purified Water, U.S.P. | 9.0 |
| FD & C Yellow #6 Powder | 2.0 |
| Titanium Dioxide | 1.0 |
| Vegetable Shortening | 58.0 |
| Soybean Oil, U.S.P. | 901.0 |
| Fumed (Colloidal) Silica | 29.0 |
| | 1000.0 |

The product of Example 3 is prepared and encapsulated according to the procedure of Example 1.

EXAMPLE 4

PREPARATION AND ENCAPSULATION OF TARGET SHOOTING CAPSULES CONTAINING A RED FILL MATERIAL
Formula IV

| Ingredient | Amount (g) |
|---|---|
| D & C Red #7 Calcium Lake 48% Powder | 6.0 |
| Soybean Oil, U.S.P. | 963.0 |
| Fumed (Colloidal) Silica | 31.0 |
| | 1000.0 |

Into a suitable container is weighed 6.0 g of D & C Red #7 calcium lake 48% powder. To a container is added 963.0 g of soybean oil, U.S.P. While stirring on a high speed mixer equipped with a dissolver blade, the D & C Red #7 is added to the oil. Stirring is continued until the mixture is uniform. While stirring, 31.0 g of fumed (colloidal) silica is added. Stirring is continued until the mixture is uniform. The temperature of the mixture is maintained below about 32° C. After mixing, the batch is allowed to cool to room temperature. The mixture is restirred prior to delivery to capsulation.

Separately, using conventional techniques, substantially spherical soft elastic gelatin capsules are prepared to have a dry wall thickness of about 0.008 inches and a diameter of about 0.25 inches and are filled with approximately 0.12 cc of the red fill material.

EXAMPLES 5–8

The procedures of Examples 1–4 are followed except that the gelatin capsules are prepared with a diameter of about 0.177 inches and are filled with approximately 0.03 cc of the desired fill material of the example.

EXAMPLES 9–12

The procedure of Examples 1–4 are followed except that the gelatin capsules are prepared with a diameter of about 0.22 inches and are filled with approximately 0.06 cc of the desired fill material of the example.

In the foregoing there has been provided a detailed description of preferred embodiments of the present invention for the purpose of illustration and not limitation. It is to be understood that all other modifications, ramifications and equivalents obvious to those having skill in the art based on this disclosure are intended to be within the scope of the invention as claimed.

What is claimed is:

1. A target shooting capsule comprising a substantially spherical, nontoxic, soft elastic gelatin capsule having a dry wall thickness of about 0.004 inches to about 0.013 inches, having a diameter of about 0.16 inches to about 0.265 inches, and containing about 0.03 cc to about 0.12 cc of a water washable, nontoxic dye fill material.

2. The target shooting capsule of claim 1 wherein the dry wall thickness is about 0.007 inches to about 0.01 inches, the diameter is about 0.177 inches and said gelatin capsule contains about 0.03 cc of a water washable, nontoxic dye fill material.

3. The target shooting capsule of claim 1 wherein the dry wall thickness is about 0.007 inches to about 0.01 inches, the diameter is about 0.22 inches and said gelatin capsule contains about 0.06 cc of a water washable, nontoxic dye fill material.

4. The target shooting capsule of claim 1 wherein the dry wall thickness is about 0.007 inches to about 0.01 inches, the diameter is about 0.25 inches and said gelatin capsule contains about 0.12 cc of a water washable, nontoxic dye fill material.

5. A water washable, nontoxic formulation useful as a fill material for a target shooting capsule comprising water, a coloring powder, titanium dioxide, vegetable shortening, vegetable oil and fumed silica.

6. The water washable, nontoxic formulation of claim 5 wherein the coloring powder is blue, yellow, a mixture of blue and yellow or red.

7. The water washable, nontoxic formulation of claim 5 wherein the water is present in the amount of about 0.7% to about 1.0% (w/w), the coloring powder is present in the amount of about 0.005% to about 0.4% (w/w), the titanium dioxide is present in the amount of about 0.05% to about 0.2% (w/w), the vegetable shortening is present in the amount of about 4% to about 7% (w/w), the vegetable oil is present in the amount of about 87% to about 94% (w/w) and the fumed silica is present in the amount of about 2% to about 4% (w/w).

8. A water washable, nontoxic formulation useful as a red fill material for a target shooting capsule comprising a red coloring powder, vegetable oil and fumed silica.

9. The water washable, nontoxic formulation of claim 8 wherein the red coloring powder is present in the amount of about 0.4% to about 0.7% (w/w), the vegetable oil is present in the amount of about 95% to about 98% (w/w) and the fumed silica is present in the amount of about 2% to about 4% (w/w).

* * * * *